US005706020A

United States Patent [19]

Iwama

[11] Patent Number: 5,706,020

[45] Date of Patent: Jan. 6, 1998

[54] PLASMA ADDRESSED DISPLAY

[75] Inventor: Jun Iwama, Kanagawa, Japan

[73] Assignee: Sony Corporation, Tokyo, Japan

[21] Appl. No.: 644,960

[22] Filed: May 13, 1996

[30] Foreign Application Priority Data

May 12, 1995 [JP] Japan ..... 7-138704

[51] Int. Cl.[6] ..... G09G 3/28

[52] U.S. Cl. ..... 345/60; 345/87; 345/63

[58] Field of Search ..... 345/37, 41, 42, 345/60, 63, 66, 67, 68, 84, 87; 315/169.4

[56] References Cited

U.S. PATENT DOCUMENTS

| | | | |
|---|---|---|---|
| 4,242,679 | 12/1980 | Morozumi et al. | 345/208 |
| 4,896,149 | 1/1990 | Buzak et al. | 345/60 |
| 5,077,553 | 12/1991 | Buzak | 345/87 |
| 5,349,454 | 9/1994 | Iwama | 345/60 |

*Primary Examiner*—Richard Hjerpe
*Assistant Examiner*—Ricardo Osorio
*Attorney, Agent, or Firm*—Hill, Steadman and Simpson

[57] ABSTRACT

To optimize a discharge current flowing in each of discharge channels for performing linear sequential scan of a display cell, a panel 0 has a laminated structure in which a display cell having signal electrodes D arranged in columns and a plasma cell having discharge channels (K,A) arranged in rows are laminated to each other. Pixels 1 are defined in a matrix at positions where the signal electrodes D cross the discharge channels (K,A). A vertical drive circuit 2 repeatedly performs field scans in each of which pixels 1 are selected in a row-sequential manner by sequentially applying drive pulses each to the signal channels (K,A) for generating plasma discharges. A horizontal drive circuit 3 applies image signals each to the signal electrodes D, to write the image signals in the selected pixels 1. The vertical drive circuit 2 includes a detecting resistance 14 for detecting a discharge state of each discharge channel (K,A) for each field scan. The vertical drive circuit 2 also includes a control means having a comparator 17, a memory 19, a flip-flop 13 and the like for controlling, on the basis of a detected result obtained in the previous field scan, a width of each of the drive pulses Q1 to Qn to be applied in the next field scan for each discharge channel.

6 Claims, 3 Drawing Sheets

FIG. 1A
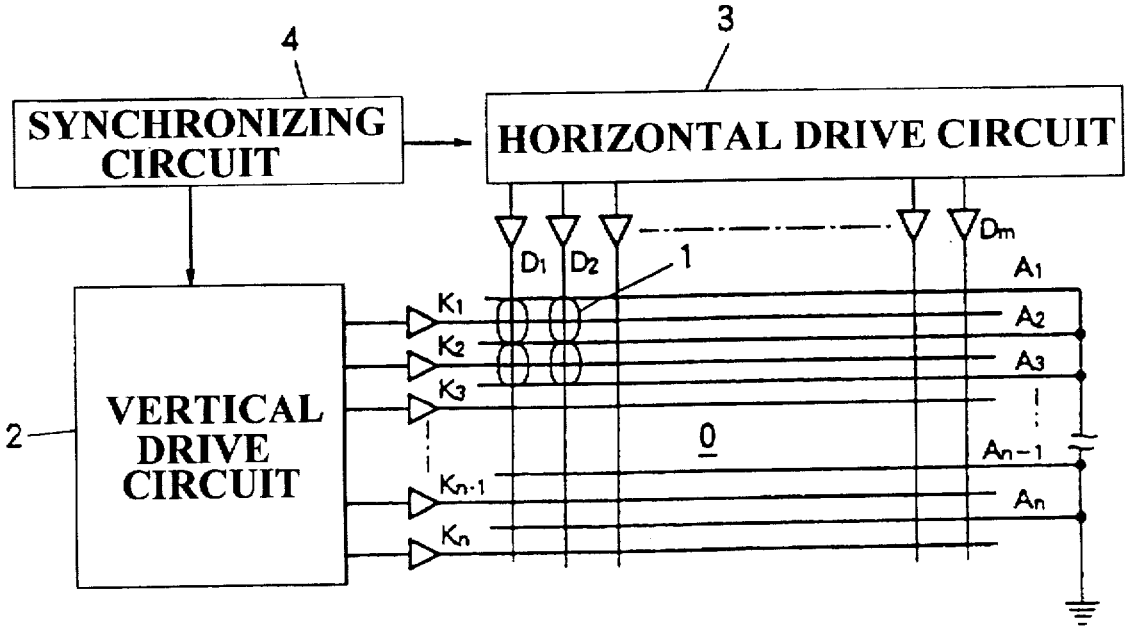
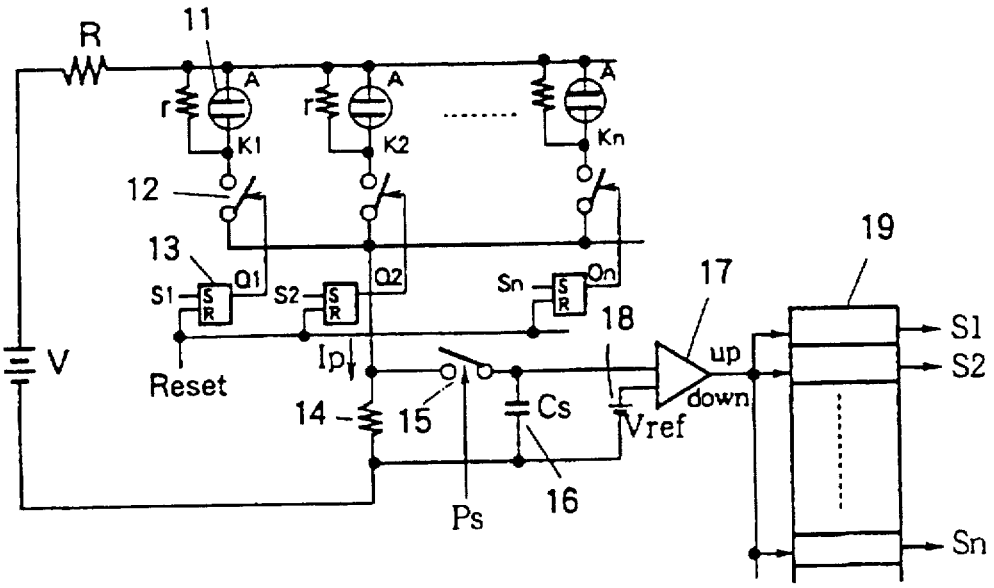
FIG. 1B

PLASMA ADDRESSED DISPLAY

BACKGROUND OF THE INVENTION

1. Field of the Invention

The present invention relates generally to a plasma addressed display using a panel having a laminated structure in which a plasma cell and a display cell are laminated to each other. In particular, the present invention relates to a plasma drive circuit for driving a plurality of discharge channels provided in a plasma cell so as to generate plasma discharges in a sequential selection manner, and more particularly to a control technique for controlling a discharge current.

2. Description of the Related Art

A plasma addressed display panel having such a structure as shown in FIG. 3 has been disclosed in U.S. Pat. No. 5,077,553. The plasma addressed display panel has a laminated structure in which a display cell 101 is laminated on a plasma cell 102 through an intermediate base member 103 made of a thin glass plate. The plasma cell 102 is formed of a lower base member 104, on the surface of which a plurality of grooves 105 are provided in parallel to each other. Each of the grooves 105 is hermetically sealed by the intermediate base member 103. An ionizable gas is sealed in each groove 105. The grooves 105 thus form discharge channels 106 which are separated from each other. A projecting wall portion 107 interposed between the adjacent ones of the grooves 105 serves as a bulkhead for separating the adjacent ones of the discharge channels 106 from each other, and it also serves as a gap spacer between the lower base member 104 and the intermediate base member 103. A pair of parallel discharge electrodes 108, 109 are provided on the bottom portion of each of the grooves 105. These electrodes 108, 109 function as an anode electrode and a cathode electrode for ionizing a gas in the discharge channel 106 and generating a plasma discharge. On the other hand, the display cell 101 has an opto-electronic material such as a liquid crystal 111 or the like held between the intermediate base member 103 and an upper base member 110. Stripe-shaped signal electrodes 112 are formed on the inner surface of the upper base member 110. The signal electrodes 112 cross the discharge channels 106. The signal electrodes 112 arranged in columns function as column drive units while the discharge channels 106 arranged in rows function as row drive units. Pixels are defined in a matrix at positions where the signal electrodes 112 cross the discharge channels 106.

A pair of a vertical drive circuit and a horizontal circuit are used for driving the plasma addressed display panel having such a configuration. The vertical drive circuit repeatedly performs field scans in each of which pixels are selected in a row-sequential manner (linear sequential manner) by sequentially applying drive pulses each to the discharge channels 106 for generating plasma discharges. On the other hand, the horizontal drive circuit applies image signals each to the signal electrodes in synchronization with the linear sequential scan of the discharge channels, to thereby write the image signals in selected pixels. When a plasma discharge is generated in a discharge channel 106, the interior of the discharge channel is kept approximately in an anode potential. When an image signal is applied to a signal electrode 112 in such a state, the image signal is written in a liquid crystal 111 of a corresponding pixel through the intermediate base member 103. After the plasma discharge is ended, the discharge channel 106 is kept at a floating potential, and thereby the written image signal is kept at the pixel. A so-called sampling hold is thus carried out, wherein the discharge channel 106 functions as a sampling switch while the liquid crystal 111 functions as a sampling capacitor. The transmissivity of the liquid crystal is changed in accordance with the image signal that is thus held in the pixel as the held sample. As a result, the brightness of the plasma addressed display panel can be controlled pixel-by-pixel.

FIG. 4 is a circuit diagram showing one example of prior an vertical drive circuits (plasma drive circuits). In this figure, character V indicates a source voltage for generating the plasma discharge; R is a resistance for restricting a discharge current flowing into each discharge channel; A is an anode electrode; and K is a cathode electrode. One discharge channel is formed of a pair of an anode electrode and a cathode electrode. Character "r" indicates a pull-up resistance for holding a cathode electrode at an anode potential in a non-selection state. The plasma drive circuit sequentially applies drive pulses each to the discharge channels by sequentially turning on/off switches SW1 to SWn, to thereby generate plasma discharges in the discharge channels. Image signals are each supplied to signal electrodes (not shown) in synchronization with the linear sequential scan of the discharge channels, to write the image signals in pixels corresponding to the selected discharge channels. Such an operation is repeated for each field.

In the prior art circuit shown in FIG. 4, a width of each drive pulse (on-time of each of the switches SW1 to SWn) is determined to generate a stable plasma discharge in any one of the discharge channels. Consequently, in the case where variations in discharge characteristics are present among the discharge channels, the width of each drive pulse is such as to generate a stable plasma discharge even in a discharge channel where it may be difficult to generate the plasma discharge. In other words, the width of each drive pulse is uniformly set with a certain allowance added thereto. Incidentally, a discharge electrode is subjected to sputtering by plasma particles upon generation of the plasma discharge. Then, an electrode material which has thus been sputtered sticks on the glass base member to lower the transmissivity of the panel over time, resulting in a reduced service life for the panel. The generation of sputtering becomes larger depending on a magnitude of a discharge current. In other words, the likelihood of sputtering beginning is increased and the quantity of material sputtered increases. As a result, the width of each drive pulse for carrying out a discharge current is preferably to be reduced as much as possible. In the configuration of the prior art circuit, however, the width of each drive pulse is set to be uniform, and accordingly an excessive discharge current tends to flow in the discharge channels where it is relatively easy to generate a plasma discharge. As a result, in the prior art, it is impossible to effectively suppress the generation of sputtering of the discharge electrodes.

SUMMARY OF THE INVENTION

The present invention provides the following means for solving the above problems of the prior art. Namely, a plasma addressed display of the present invention basically includes a panel, a vertical drive circuit and a horizontal drive circuit. The panel has a laminated structure in which a display cell having signal electrodes arranged in columns and a plasma cell having discharge channels arranged in rows are laminated to each other, pixels being defined in a matrix at positions where the signal electrodes cross the discharge channels. The vertical drive circuit repeatedly performs field scans in each of which pixels are selected in a row-sequential manner by sequentially applying drive pulses each to the discharge channels for generating the plasma discharges. The horizontal drive circuit applies image signals each to the signal electrodes thereby writing the image signals in selected pixels. As a feature of the present invention, the vertical drive circuit includes a detecting means and a control means. The detecting means detects a discharge state of each of the discharge channels for each field scan. The control means controls, on the basis of a detected result obtained in the previous field scan of the detecting means, widths of drive pulses applied in the next field for each of the discharge channels.

Specifically, the control means controls a width of a drive pulse by changing, in accordance with a detected result, a rise time of the drive pulse on the basis of a fixed fall time of the drive pulse. More specifically, the detecting means detects a discharge current representing a discharge state of each discharge channel and outputs a detection signal corresponding to the discharge current as a detected result. In this case, the control means compares the detection signal with a specified reference signal and controls an width of the drive pulse to be increased or decreased on the basis of the compared result.

According to the present invention, a discharge state of each discharge channel is detected for each field scan, and on the basis of a detected result obtained in the previous field scan, widths of drive pulses to be applied in the next field scan are controlled for each discharge channel. Since a width of each drive pulse which is capable of optimizing a discharge current is controlled in real time for each discharge channel, it is possible to generate a stable plasma discharge irrespective of both a variation in discharge characteristics and a change over time for each line. A discharge current is controlled to be minimized for each discharge channel.

BRIEF DESCRIPTION OF THE DRAWINGS

FIG. 1A is a circuit diagram showing the entire configuration of a plasma addressed display of the present invention.

FIG. 1B is a circuit diagram showing the configuration of an essential portion of the plasma addressed display shown in FIG. 1A.

DETAILED DESCRIPTION OF THE PREFERRED EMBODIMENTS

Figure 3:
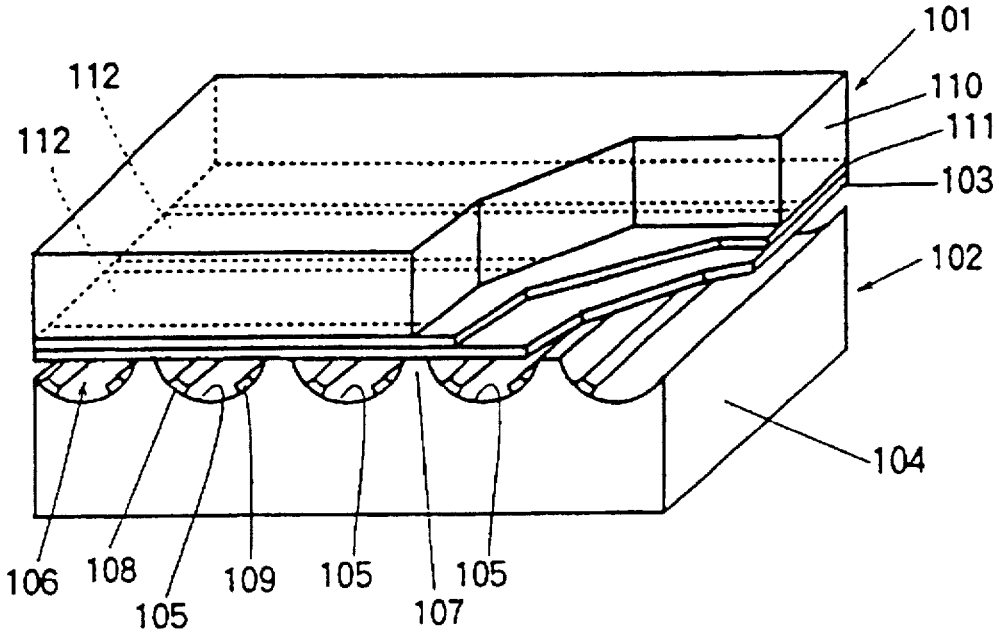
FIG. 3 (PRIOR ART)
FIG. 3 is a perspective view showing a general configuration of a plasma addressed display panel, with pans partially cutaway.
Figure 4:
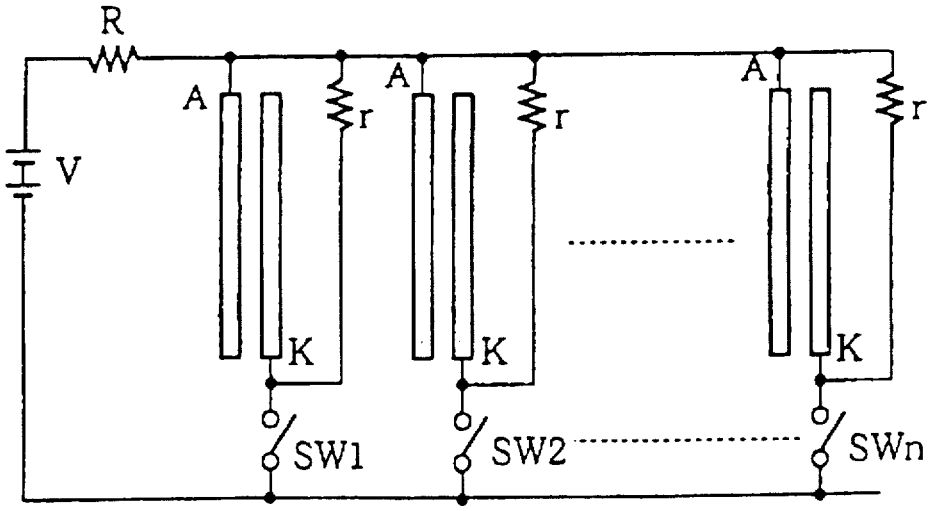
FIG. 4 (PRIOR ART)
FIG. 4 is a circuit diagram showing the configuration of a drive circuit of a prior an plasma addressed display panel.

Hereinafter, one preferred embodiment of the present invention will be described with reference to the drawings. FIGS. 1A and 1B are circuit diagrams showing one embodiment of a plasma addressed display of the present invention. FIG. 1A shows an entire configuration of the plasma addressed display, and FIG. 1B is an actual circuit configuration of an essential portion of the display shown in FIG. 1A. Referring first to FIG. 1A, the plasma addressed display of the present invention has a panel 0 in which a display cell and a plasma cell are laminated to each other. The panel 0 has a basic structure similar to that shown in FIG. 3. The display cell includes signal electrodes D1 to Dm arranged in columns. The plasma cell includes discharge channels arranged in rows. Each discharge channel is formed of a pair of an anode electrode A and a cathode electrode K. The cathode electrodes K1 to Kn are arranged in the vertical direction. The anode electrodes A1 to An are alternated with the cathode electrodes K1 to Kn, and are all grounded. Pixels 1 are defined in a matrix at positions where the signal electrodes D arranged in columns cross the discharge channels (K, A) arranged in rows. The display of the present invention further includes a vertical drive circuit 2 for applying drive pulses each to the cathode electrodes K of the discharge channels in a linear sequential scan. This allows each discharge channel to generate a plasma discharge. The display also includes a horizontal drive circuit 3 for sequentially applying image signals each to the signal electrodes D in synchronization with the linear sequential scan of the discharge channels thereby displaying a desirable image. The vertical drive circuit 2 and the horizontal drive circuit 3 are controlled to be synchronized with each other by a synchronizing circuit 4.

As a feature of the present invention, the vertical drive circuit 2 includes a detecting means and a control means. The detecting means detects a discharge state of each discharge channel (K, A) for each field scan, and on the basis of a detected result obtained in the previous field scan, it controls the widths of the drive pulses to be applied in the next field scan for each discharge channel (K,A). Specifically, the control means controls a width of a drive pulse to be applied to each cathode electrode K by changing, in accordance with a detected result, a rise timing of the drive pulse on the basis of a fixed fall timing of the drive pulse. More specifically, the detecting means detects a discharge current representing a discharge state of each discharge channel (K,A) and outputs a corresponding detection signal as a detected result. In this case, the control means compares the detection signal with a reference signal, and it controls a width of the drive pulse to be increased or decreased on the basis of the compared result.

The actual configuration of the vertical drive circuit shown in FIG. 1A will be described in detail with reference to FIG. 1B. In FIG. 1B, reference numeral 11 indicates a discharge channel, which is formed of a pair of an anode electrode A and a cathode electrode K. A pull-up resistance "r" is connected to each of the cathode electrodes K1 to Kn. A source voltage V is applied to the anode electrodes A through a current restricting resistance R. Reference numeral 12 indicates a switch which is opened/closed for supplying a drive pulse to a corresponding one of the cathode electrodes K1 to Kn. The group of these switches 12 constitutes a cathode driver. Reference numeral 13 indicates a flip-flop for controlling on/off (opening/closing) of the above cathode switch, which includes two input terminals S, R and one output terminal Q. In the flip-flop 13, a reset signal "Reset" is applied to one input terminal R, while a corresponding one of the set signals S1 to Sn is applied to the other input terminal S. Reference numeral 14 indicates a detecting resistance for a discharge current Ip; 15 is a sampling switch; 16 is a hold capacitor (Cs); 18 is a reference power source; and 17 is a comparator. The sampling switch 15 is opened/closed in accordance with a sampling pulse Ps. The reference power source 18 supplies a specified reference signal Vref to the comparator 17. The comparator 17 compares a terminal voltage of the hold capacitor Cs with the reference signal Vref, and on the basis of the result, it outputs an increment signal "up" or a decrement signal "down". Finally, the reference numeral 19 indicates a memory for setting a discharge starting timing, which functions to move a discharge starting position fore and aft on the basis of a detected result supplied from the comparator 17. As is apparent from the above-described description, the control means comprises the flip-flop 13, comparator 17, memory 19 and the like for controlling widths of drive pulses for each discharge channel. More specifically, the control means controls a width of each drive pulse by changing a rise timing of the drive pulse on the basis of a fixed fall timing of the drive pulse.

Figure 2:
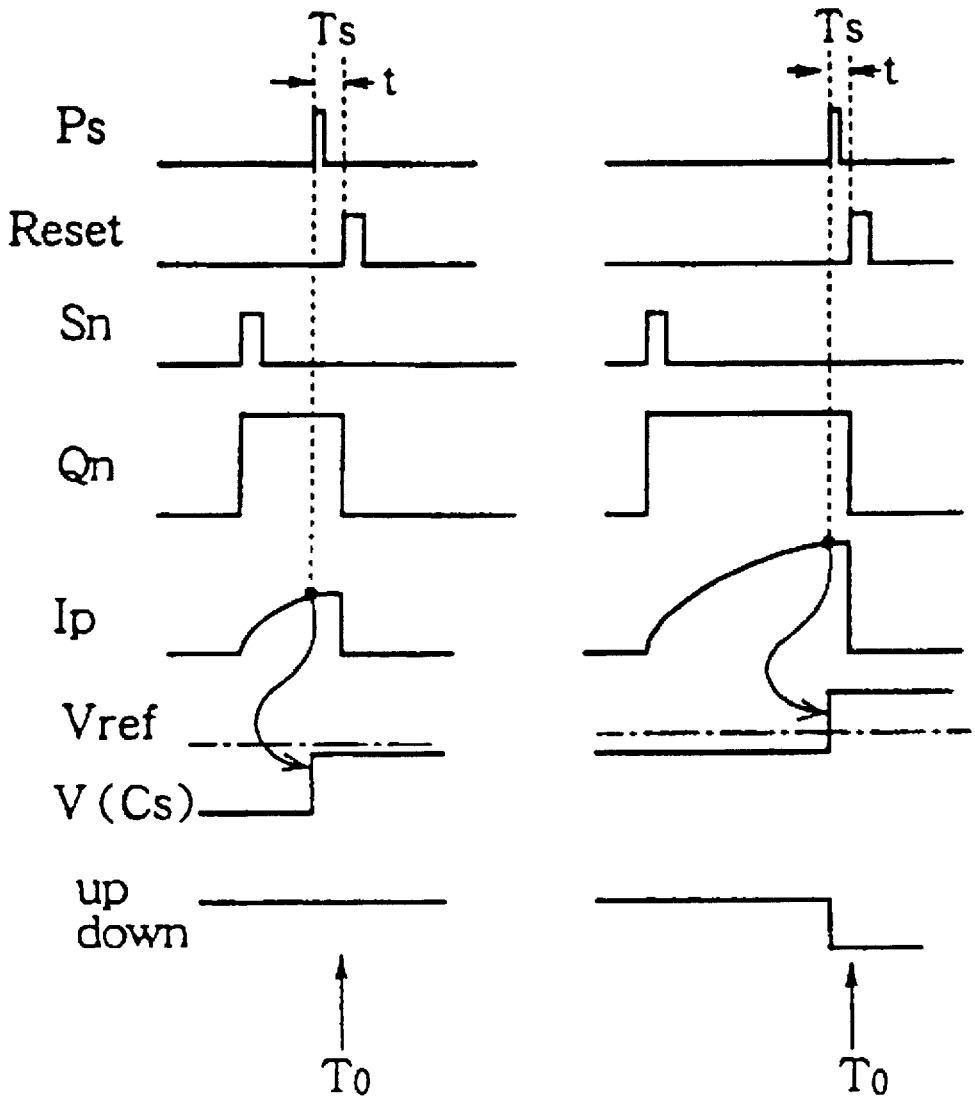
FIG. 2 is a timing chart illustrating an operation of the plasma addressed display shown in FIGS. 1A and 1B.

Finally, the operation of the circuit shown in FIG. 1B will be described in detail with reference to FIG. 2. For the plasma addressed display panel, a writing timing of an image signal (data) depends on an ending point of the plasma discharge, and consequently the reset pulse "Reset" for ending the plasma discharge is fixed at a position To. Namely, a fall timing of each drive pulse Qn is fixed to the position To. The magnitude of the discharge current is detected through the detecting resistance 14 with a timing period Ts that begins slightly earlier than the timing To. Specifically, the sampling switch 15 is opened/closed in accordance with the sampling pulse signal Ps for each line. The detected result is held in the hold capacitor 16 by the operation of the switch 15. The terminal voltage V(Cs) of the hold capacitor 16 is compared with the reference voltage Vref of the reference power source 18 in the comparator 17, and a signal "up/down" is output therefrom. A value for determining a discharge starting timing of each discharge channel, which is stored in the memory 19, is increased/decreased on the basis of the signal "up/down". Specifically, when the terminal voltage V(Cs) of the hold capacitor 16 is smaller than the reference voltage Vref, the value in the memory 19 is rewritten, and the position of the set signal Sn in the next field is further moved forward from the position To, thereby extending the width of the drive pulse Qn. When the terminal voltage V(Cs) exceeds the reference voltage Vref in a certain field, the content of the memory 19 is rewritten such that the set signal Sn comes near the position To. Consequently, it is possible to usually ensure a stable plasma discharge with the minimum width of each drive pulse by suitably selecting both a width "t" between the sampling timing Ts and the discharge ending timing To, and a width for changing the set signal Sn.

As described above, according to the present invention, on the basis of a detected result of a discharge current obtained in the previous field scan, widths of the drive pulses to be applied in the next field scan are optimally controlled for each discharge channel. The width of each drive pulse which is capable of optimizing a discharge current can be thus controlled in real time for each line, and accordingly it is possible to realize a stable plasma discharge irrespective of both a variation in discharge characteristics and a change with time in each discharge channel. This makes it possible to ensure data writing in the display cell. In addition, the life of the plasma addressed display panel can be prolonged since each discharge current is minimized.

Although other modifications and changes may be suggested by those skilled in the art, it is the intention of the inventors to embody within the patent warranted hereon all changes and modifications as reasonably and properly come within the scope of their contribution to the art.

I claim:

1. A plasma addressed electro-optical display device, comprising:

a flat panel having:

an electro-optical cell including signal electrodes, and a plasma discharge cell having plasma discharge channels arranged in rows to define pixels by intersections of the signal electrodes and the plasma discharge channels;

a vertical drive circuit for scanning each of said pixels in a field scan by sequentially applying drive pulses to said discharge channels for generating plasma discharges, said vertical drive circuit including:

a detecting means for detecting a discharge state of each of said discharge channels for each field scan, and a control means for controlling, on a basis of a detected result obtained in a previous field scan, widths of drive pulses applied in a next field scan for each of said discharge channels; and a horizontal drive circuit for applying image signals to selected ones of said signal electrodes to write the image signals in selected ones of said pixels.

2. A plasma addressed electro-optical display device as claimed in claim 1, wherein said detecting means comprises a resistance connected to receive a drive current during discharge.

3. A plasma addressed electro-optical display device as claimed in claim 2, wherein said control means comprises a flip-flop connected to activate the discharge, a comparator connected to receive a voltage across the resistance, and a memory connected at the output of the comparator.

4. A plasma addressed electro-optical display device as claimed in claim 1, wherein said control means controls a width of a driving pulse by changing a rising edge of a next driving pulse on a basis of a fixed falling edge of the driving pulse in accordance with a result of detection by said detection means.

5. A plasma addressed electro-optical display device as claimed in claim 1, wherein said detecting means includes means for detecting a discharge current representing a discharge state of each discharge channel and outputting a detection signal corresponding to the discharge current as a detected result.

6. A plasma addressed electro-optical display device as claimed in claim 1, said control means includes means for controlling a width of the drying pulse on a basis of a result of a comparison of said detection signal and a predetermined reference signal.

* * * * *